US005863056A

United States Patent [19]

Hostetter

[11] Patent Number: 5,863,056

[45] Date of Patent: Jan. 26, 1999

[54] MATTRESS MOVING SYSTEM

[76] Inventor: Robert D. Hostetter, P.O. Box 1250, Pinedale, Ariz.

[21] Appl. No.: 95,525

[22] Filed: Jun. 10, 1998

[51] Int. Cl.[6] ..... B65D 63/18; B65D 7/12

[52] U.S. Cl. ..... 270/47.371; 280/797; 294/152; 294/157

[58] Field of Search ..... 280/47.371, 414.2, 280/79.7, 79.11; 5/510, 703; 294/149, 152, 157

[56] References Cited

U.S. PATENT DOCUMENTS

| | | | |
|---|---|---|---|
| 958,347 | 5/1910 | Younglove . | |
| 1,579,420 | 4/1926 | Welch . | |
| 1,689,960 | 10/1928 | Nelson . | |
| 2,508,795 | 5/1950 | Nielson . | |
| 3,214,072 | 10/1965 | Brown . | |
| 4,119,250 | 10/1978 | Brutlag | 224/49 |
| 4,553,780 | 11/1985 | Strachan | 294/152 |
| 4,953,904 | 9/1990 | Dandoise | 294/15 |
| 5,503,448 | 4/1996 | Dewey | 294/152 |

*Primary Examiner*—Brian L. Johnson
*Assistant Examiner*—Jeffrey Restifo
*Attorney, Agent, or Firm*—Joseph N. Breaux

[57] ABSTRACT

A complete mattress moving system which includes a horizontal strap with two detachable, rotating and adjustable handles, a pair of vertical straps each with an expandable, detachable and position adjustable castered platform. The horizontal strap wraps around and is secured to the mattress lengthwise while the handles are positioned on opposite mattress end edges, the vertical straps extend from the horizontal strap on opposite sides of the mattress and wrap halfway around the mattress widthwise, while the castered platforms are positioned on the mattress side edges and slidably attached to each vertical strap. Quick-release buckles allow the horizontal and vertical straps to be adjusted to fit any size mattress, box springs or other similarly shaped object to be moved. The system allows a mattress to be moved by a single worker, helps prevent injuries, and provides a quick and easy device for handling and moving a mattress.

4 Claims, 2 Drawing Sheets

MATTRESS MOVING SYSTEM

TECHNICAL FIELD

The present invention relates to devices and methods for moving mattresses and more particularly to devices and methods which provide a mattress moving system comprising a harness with a number of quick release buckles secured together to form a horizontal mattress strap and a pair of downwardly projecting vertical holding straps which include adaptable portions for connecting to a pair of detachable castered bases each incorporating a plurality of rollers for easily moving the, while the horizontal strap includes a pair of detachable rotating handles providing a gripping means.

BACKGROUND ART

Moving mattresses is difficult because a mattress is heavy, hard to get a good grip on, and cumbersome to handle because they sag or droop when stood on edge. Moving personnel usually employ two workers to handle the task of moving a mattress. The present invention provides a system which allows a single worker to quickly move a mattress, provides a means for handling a mattress so the mattress can be quickly moved and provides a system for moving a mattress which helps prevent worker injuries.

Prior devices have been patented which help moved mattresses, these devices are useful for their disclosed purposes however they do not provide a complete system for moving a mattress as the present invention which allows a mattress to be move by a single worker and also helps prevent worker injuries. The prior patents which are relevant are as follows:

Dewey U.S. Pat. No. 5,503,448 discloses a strap apparatus for hauling large objects.

Staats, Jr. U.S. Pat. No. 5,102,178 discloses a carrying device.

Strachan U.S. Pat. No. 4,553,780 discloses a mattress carrying harness.

Heart U.S. Pat. No. 4,521,045 discloses a mattress carrier.

Weilert U.S. Pat. No. 4,431,226 discloses a large mattress carrying device.

Brutlag U.S. Pat. No. 4,119,250 discloses a mattress carrying device.

Brown U.S. Pat. No. 3,214,072 discloses a mattress carrying sling for use by two men in carrying a mattress to restricted areas, such as doors.

Nielsen U.S. Pat. No. 2,508,795 discloses a mattress carrying harness which is readily adaptable to a bed mattress or other bulky article.

Nelson U.S. Pat. No. 1,689,960 discloses a mattress carrier useful for carrying a rolled mattress.

Welch U.S. Pat. No. 1,579,420 discloses a mattress carrier.

Younglove, U.S. Pat. No. 958,347 discloses a tool bag.

Although numerous prior devices have been developed which disclose a harness system for carrying bulky items such as mattresses, these prior devices do not provide a complete system for moving a bulky mattress as the present invention which utilizes a pair of castered platforms which are attached to vertical straps which in turn are attached to a horizontal strap member which also includes a pair of detachable and adjustable rotating handling. The present device provides a complete system for not only handling a mattress but also moving a mattress on the castered platforms with ease.

GENERAL SUMMARY DISCUSSION OF INVENTION

It is thus an object of the invention to provide a Mattress Moving System that provides a quick release horizontal strap which wraps around a mattress length and includes a pair of detachable rotating handles mounted on opposite end edges of the strap while the horizontal strap provides a connecting point for a pair of vertical straps with quick-release straps each fitted with a castered platform that are positioned on a side edge of the mattress.

It is a further object of the invention to provide a Mattress Moving System that provides a system for moving mattresses which can be easily accomplished by one person.

It is a still further object of the invention to provide a Mattress Moving System that helps reduce the occurrence of injuries for person who move mattresses.

Accordingly, a Mattress Moving System is provided that includes a horizontal strap made from durable nylon, or like material, fitted with an adjustable quick-release style buckle and a pair of detachable rotating handles placed on opposing mattress end edges. A pair of vertical straps are looped around the horizontal strap while each is fitted with quick-release buckles and a bottom mounted adjustable platform with casters. In use a mattress is first laid on one side, the horizontal strap is wrapped around the mattress lengthwise while the quick-release buckle allows the strap to be adjusted according to the mattress size, the detachable handles are positioned at the center of each end edge of the mattress. The mattress is then stood up on one length edge. One end of the mattress is raised for attaching one of the vertical straps around the width of the mattress and the horizontal strap, the caster platform is placed on the length edge of the mattress, this process is repeated for the other vertical strap. The mattress is now strapped to a pair of castered platforms, the user then moves the mattress by pulling the mattress from one of the detachable handles on the end edges of the mattress.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from the following description that the mattress moving system includes numerous elements all of which are necessary for carrying out the invention. The system includes a horizontal strap which wraps around a mattress lengthwise while a pair of moveable handles are positioned on the horizontal strap so that they are conveniently placed for the mover. A pair of vertical straps extend from the horizontal strap and wrap halfway around the mattress from the horizontal strap on one side of the mattress to the horizontal strap on the other side of the mattress. A pair of castered platforms each of which is positioned on a vertical strap so that the castered platform is positioned on the side edge of the bed allows the mattress to be easily moved by a single worker. The invention is installed on a mattress by first installing the horizontal strap utilizing a quick-release buckle and which buckle allows the strap to be adjusted to fit a mattress dimension lengthwise. The detachable rotating handles are then moved along the horizontal strap so that one handle is located on each end edge of the mattress to be conveniently placed for the worker. The pair of vertical straps which include the castered platforms are then wrapped around the width of the mattress so that both castered platforms are along one side edge of the mattress. The mattress is then stood on edge resting on the castered platforms. The user would then grip a handle positioned on the mattress end edge and pull the mattress to a desired location.

Figure 1:
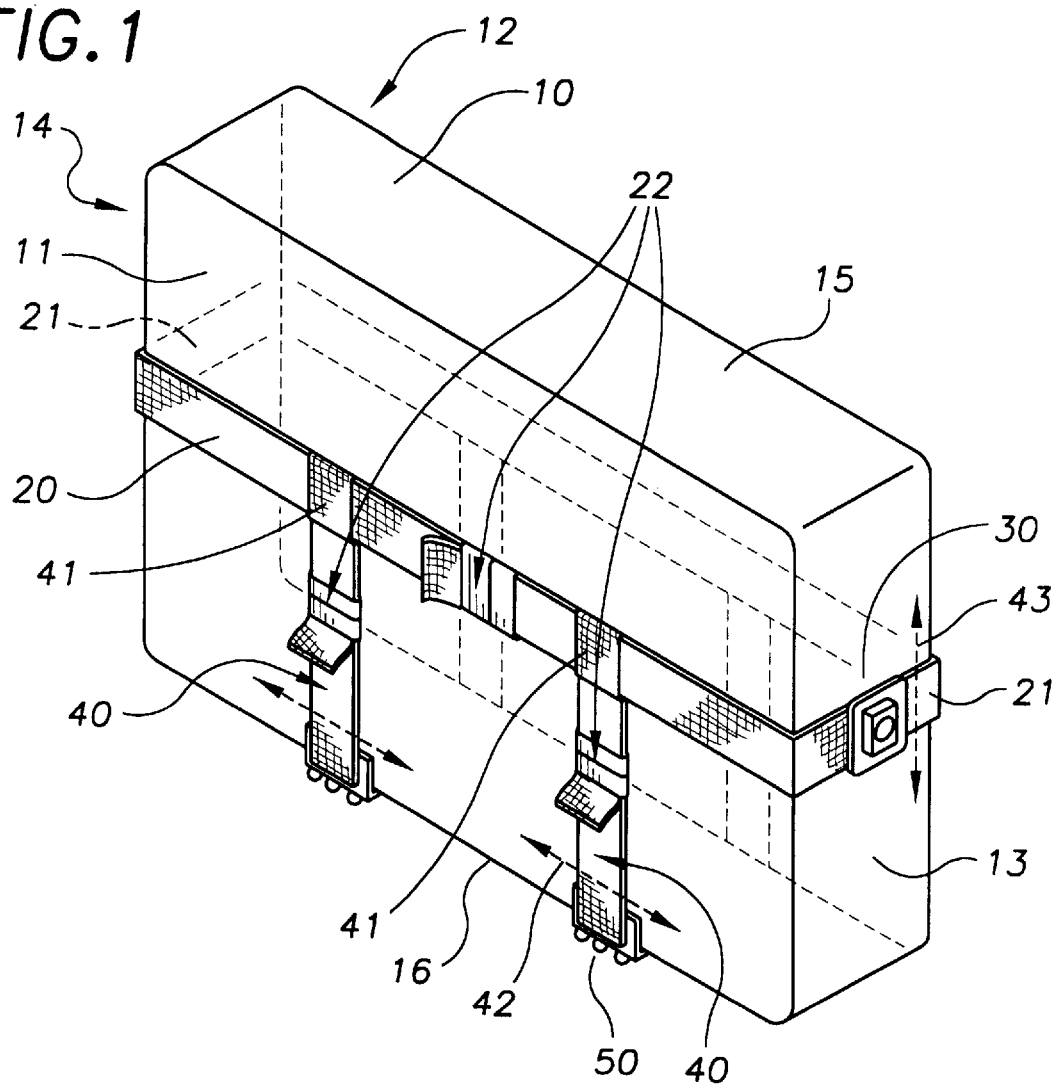
FIG. 1 is an isometric view of the complete mattress moving system mounted to a mattress ready for moving illustrating the horizontal strap, pair of vertical straps, quick-release buckles, pair of castered platforms, detachable handles and other details of the invention.

Referring to the figures in detail, FIG. 1 illustrates a mattress 10 which includes two sides 11 and 12, two end edges 13 and 14 and two side edges 15 and 16. The mattress 10 may be a king size mattress, queen size, regular, or any other mattress size or box spring. Furthermore, the device may be used to handle and move objects which are similarly shaped as a mattress.

Horizontal strap 20 is wrapped around the mattress 10 lengthwise as illustrated in FIG. 1 which results in a portion of the horizontal strap 21 to be positioned on the mattress end edges 13 and 14. The horizontal strap 20 is preferably constructed of a wide strapping material which is preferably about 2 inches to about 4 inches in width and constructed of a material such as NYLONS$_{TM}$. The length of the horizontal strap is adjusted using quick-release buckle 22. The quick-release buckle 22 also allows the horizontal strap 20 to be adjusted and fitted on mattresses of varying dimensions. Positioned on the horizontal strap 20 is a pair of detachable handles 30 which handles are free to slidably move on the horizontal strap 20 so that they may be positioned in a desirable location on the horizontal strap 20. As illustrated in FIG. 1, the handles 30 are positioned on the end edges of the mattress 10 on the horizontal strap 20. This positioning allows a user to grab a handle 30 from either end of the mattress 10 when the mattress 10 is stood on edge 16 to be moved.

Figure 5:
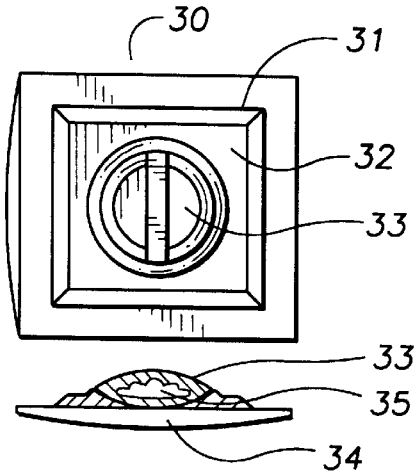
FIG. 5 includes top and side views of the detachable handle illustrating the rotating handle portion, gripping portion, and strap insert.

FIG. 5 illustrates the handle 30 in detail. The base of the handle 31 is substantially square in dimension and preferably about the same width as the horizontal strap 20. A top surface 32 of the handle base includes a circular rotating grip 33. FIG. 5 also includes a cross section side view of the handle base 33 and contoured grip 35 illustrating a strap slot 34 which provides an insert for the horizontal strap 20 to be positioned and furthermore which strap lot 34 provides a means for securing the handle 30 to the horizontal strap 20. The circular rotating grip 33 also includes contoured gripping area 35 for a user's fingers to comfortably fit within the circular grip 33 allows a user to grab the handle while the handle then rotates to a position on the handle base 31 which is most comfortable and least resistant to the user. The handle is most preferably constructed of a durable plastic material such as high density polyethylene polypropylene, ABS plastic or any other suitable plastic material.

Vertical straps 40 are positioned around the mattress lengthwise and extend from one side 11 of the mattress from the horizontal strap 20 to another side 12 of the mattress to the horizontal strap 20. The vertical straps 40 are secured to the horizontal strap 20 by a looped portion 41 which loosely fits around the horizontal strap 20 so that the vertical straps 40 remain loose and connected to the horizontal strap 20 but are free to move along the length of the horizontal strap 20 thereby providing a means for adjusting the position of the vertical straps 40 on the horizontal strap 20. The directional arrows 42 on FIG. 1 illustrate the movement of the vertical straps 40 along the horizontal strap 20 as desired. The length of the vertical straps 40 are adjusted utilizing quick release buckles 22. The length adjustment of the vertical straps 40 is dependant upon the placement of the horizontal strap 20 on the mattress 10 and the size and thickness of the mattress. As illustrated in FIG. 1 directional arrows 43 illustrate that as the horizontal strap 20 is moved up or down the mattress along the end edges 13 and 14 the vertical straps 40 must by either lengthened or shortened. Preferably, the horizontal strap 20 is placed about in the middle of the mattress 10, and then secured in place utilizing quick release buckle 22. The vertical straps 40 are then buckled and adjusted utilizing quick-release buckles 22. The position of the vertical straps 40 is preferably about one-third the length of the mattress from each end of the mattress. Vertical straps 40 are preferably constructed of identical material as the horizontal straps and further about the same width as the material used to construct the horizontal strap.

Figure 2:
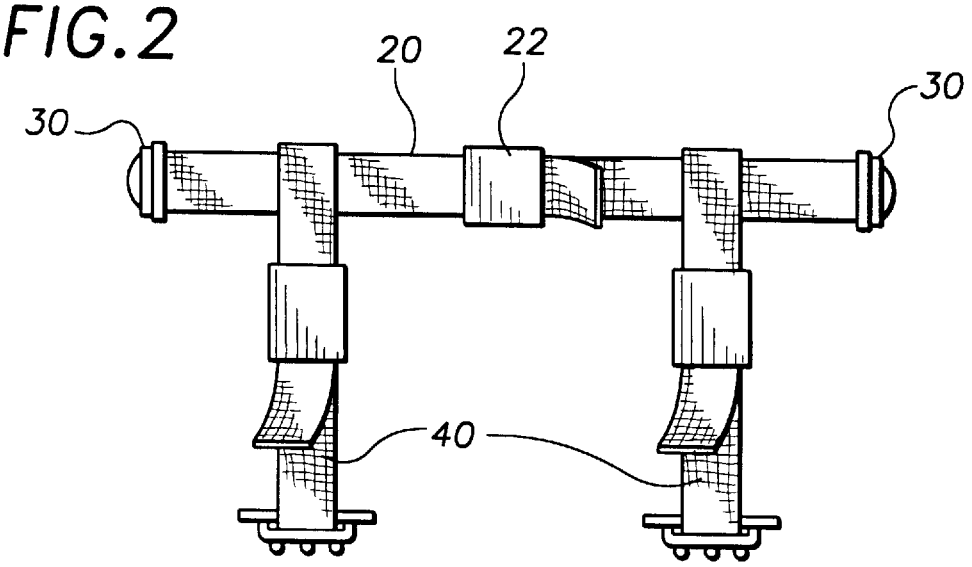
FIG. 2 is a side view of the mattress moving system illustrating the positioning of the horizontal strap and pair of vertical straps, detachable handles, and pair of castered platforms.
Figure 3:
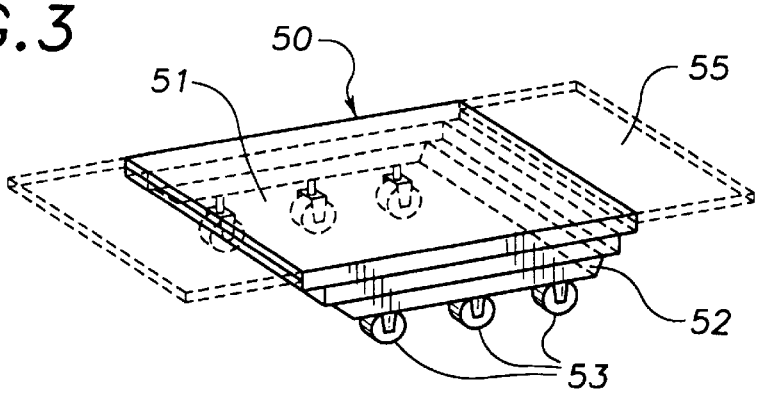
FIG. 3 is an isolated isometric view of a detachable castered platform illustrating the expandability of the platform.
Figure 4:
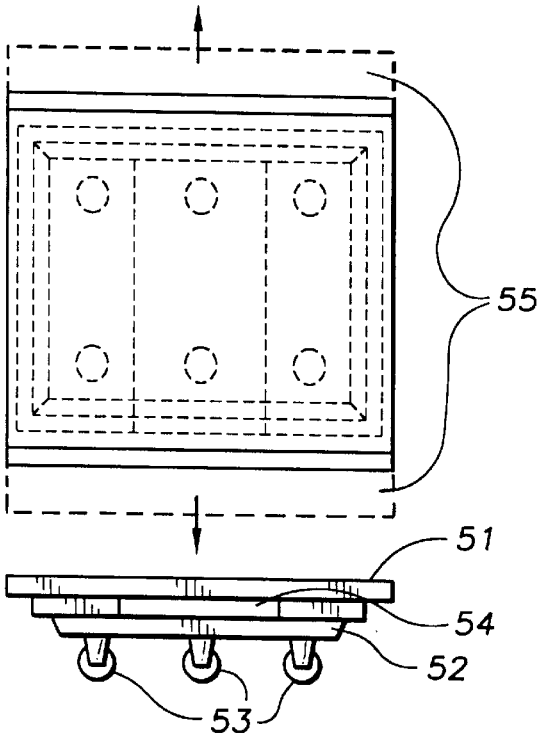
FIG. 4 includes top and side views of the detachable casted platform further illustrating the platform expandability and other features.

A pair of castered platforms 50 are provided wherein one platform is attached to each vertical strap 40. The castered platform 50 includes a top surface 51 a base 52 a multiplicity of casters 53 and a vertical strap slot 54. The vertical strap slot 54 provides an insert for a vertical strap 40 which provides a means for holding the platform 50 to the vertical strap 40 and a means for moving the platform 50 along the vertical strap 40 so that the platform 50 may be placed in an appropriate position for the mattress 10 to be moved. As illustrated in FIGS. 1 and 2 the platforms 50 are positioned on the vertical straps 40 so that the platforms 50 are positioned along a side edge 16 of the mattress 10. The castered platform 50 top surface 51 includes an expandable surface 55 which allows the platform 50 to be expanded when moving larger mattresses or loads. The castered platforms 50 are preferably constructed of a durable material such as ABS plastic, wood, or any other suitable construction material for platforms. The castered rollers 53 are preferably constructed of a metal frame with NYLON™ rollers thereby resisting scuffing of floors when using the castered platforms 50.

It is noted that the embodiment of the Mattress Moving System described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A moving platform and mattress system for moving a mattress with two sides, two end edges, and two side edges comprising: a horizontal strap which wraps around said mattress from end edge to end edge of said mattress and wherein said horizontal strap is secured in position around said mattress utilizing a quick release buckle, a pair of vertical straps each vertical strap having an end slidably connected to said horizontal strap and positioned on one side of the mattress and each vertical strap having another end slidably connected to said horizontal strap on another side of said mattress whereby the vertical straps are wrapped halfway around a mattress side edge and connected utilizing a quick release buckle, a pair of detachable handles are slidably positioned on said horizontal strap and on said mattress end edges, a pair of castered platforms each with a multiplicity of casters mounted to a castered platform base which platform base supports an expandable platform surface further wherein said castered platform is slidably connected on each vertical strap member and positioned on a mattress side edge.

2. The Mattress Moving System of claim 1, wherein said horizontal strap is positioned halfway between the side edges of said mattress and further wherein said vertical straps are positioned one-third of a length of the mattress from each end edge.

3. The Mattress Moving System of claim 1, wherein said detachable handles further comprise a rotating handle which comprises an ergonomically designed finger grip mounted to a rotating circular handle base thereby providing an ergonomic rotating grip on said detachable handle.

4. The mattress Moving System of claim 1 wherein said expandable platform surface expands in a direction lengthwise along the mattress side edge.

* * * * *